US012760990B2

(12) United States Patent
Dixon et al.

(10) Patent No.: US 12,760,990 B2
(45) Date of Patent: Oct. 13, 2026

(54) SHOTGUN HOLLOW BUTTSTOCK ADAPTER

(71) Applicant: Rhino Chokes & Gun Works, LLC, Clearwater, FL (US)

(72) Inventors: Thomas Dixon, Clearwater, FL (US); Matthew Dixon, Clearwater, FL (US)

(73) Assignee: Rhino Chokes & Gun Works, LLC, Clearwater, FL (US)

( * ) Notice: Subject to any disclaimer, the term of this patent is extended or adjusted under 35 U.S.C. 154(b) by 0 days.

(21) Appl. No.: 18/738,337

(22) Filed: Jun. 10, 2024

(65) Prior Publication Data

US 2025/0377186 A1 Dec. 11, 2025

(51) Int. Cl.
*F41C 23/20* (2006.01)
*F41C 23/08* (2006.01)

(52) U.S. Cl.
CPC ..... *F41C 23/20* (2013.01); *F41C 23/08* (2013.01)

(58) Field of Classification Search
CPC ..... F41C 23/00; F41C 23/08; F41C 23/20; F41C 23/22
See application file for complete search history.

(56) References Cited

U.S. PATENT DOCUMENTS 243,553 A * 6/1881 Hape et al. ..... F41C 23/14 42/73
1,505,146 A * 8/1924 Holub ..... F41C 23/00 42/71.01
2,292,351 A * 8/1942 Carpenter ..... F41C 23/00 42/71.01
3,011,283 A * 12/1961 Lunn ..... F41C 23/00 42/71.01
3,618,248 A * 11/1971 Into ..... F41C 23/22 42/71.01
4,934,084 A * 6/1990 Thomas ..... F41C 23/18 42/71.01
5,752,339 A * 5/1998 Bentley ..... F41C 23/06 42/74
6,012,246 A * 1/2000 Robinson ..... F41C 23/22 42/71.01
6,070,354 A * 6/2000 Burigana ..... F41C 23/18 42/71.01
6,256,921 B1 * 7/2001 Howard ..... F41C 23/18 42/71.01
7,716,864 B2 * 5/2010 Skrubis ..... F41A 3/66 42/71.01
2004/0144011 A1 * 7/2004 Vignaroli ..... F41C 23/08 42/74

(Continued)

OTHER PUBLICATIONS

Replace Benelli Vinci Recoil Pad with Limbsaver Airtech 10810. Adventures with Dr. Joe. <https://www.youtube.com/watch?v=ih4cnaOAy1U>. Sep. 7, 2023. (Year: 2023).*

*Primary Examiner* — Gabriel J. Klein
(74) *Attorney, Agent, or Firm* — Larson & Larson; Frank Liebenow

(57) ABSTRACT

The shotgun hollow buttstock adapter is designed to fit within the rear portion of a hollow shotgun buttstock, enabling users to mechanically fasten recoil pads to the buttstock. This adapter addresses the need for a simple, efficient, and secure method of attaching recoil pads to shotguns with hollow stocks, thereby enhancing recoil management and user comfort.

11 Claims, 13 Drawing Sheets

(56) References Cited

U.S. PATENT DOCUMENTS

| | | | | |
|---|---|---|---|---|
| 2007/0175077 | A1* | 8/2007 | Laney | F41C 23/06<br>42/74 |
| 2016/0010944 | A1* | 1/2016 | Downey | F41C 23/14<br>42/74 |
| 2025/0052536 | A1* | 2/2025 | Moretti | F41C 23/20 |

* cited by examiner

SHOTGUN HOLLOW BUTTSTOCK ADAPTER

FIELD

This invention relates to the field of firearms and more particularly to a system for removably attaching a butt stock cushion to a shotgun.

BACKGROUND

Shotguns are used for a variety of purposes, including hunting, sport shooting, and self-defense. The buttstock—the rear portion of the gun that rests against the user's shoulder—plays a critical role in the comfort and usability of the firearm. Traditional wood or synthetic stocks are common but tend to transmit recoil forces to the user and provide limited customization potential.

The addition of a shock absorbing pad, or recoil pad, to the end of the buttstock reduces the force transmitted to the user. But affixing the pad to the stock is problematic, with limited options for attachment. This is a particular problem for hollow butt stocks because they lack a rear attachment point.

What is needed is an adapter that allows the user with a hollow butt stock to attach the pad or shock absorbing mechanisms preferred by the user.

SUMMARY

The shotgun hollow buttstock adapter provides a novel adapter designed to fit within the rear portion of a hollow shotgun buttstock, enabling users to mechanically fasten recoil pads to the buttstock. This adapter addresses the need for a simple, efficient, and secure method of attaching recoil pads to shotguns with hollow stocks, thereby enhancing recoil management and user comfort.

In the primary embodiment, the shotgun hollow buttstock adapter has a tapered shape contoured to match the internal profile of the internal butt-end of a hollow stock. In other words, the top and bottom of the adapter are narrower than the center, creating an upper taper and a lower taper. The top is generally wider than the bottom.

The back face of the adapter includes a perimeter chamfer to reduce distortion of the butt stock while the adapter is being rotated into place. The chamber is located at the junction between the flat back face and the edge or perimeter of the adapter.

For installation, the adapter, or adapter body, is inserted at a 90° angle to its final position, then rotated or snapped into place with the edge of the device resting against the internal wall of the hollow stock. The compression of the resilient hollow buttstock is sufficient to hold the adapter plate in position-chemical fasteners or adhesives are not required.

The chamfer acts to reduce the distance between the edges, measured diagonally across the cross section of the device. In the absence of the chamfer, the distance from the front face left edge to the rear face right edge would be greater, increasing the distortion of the shotgun stock as the adapter was rotated into its final position. The chamfer produces this distance, reducing distortion of the stock to ease installation and reducing wear and tear on the stock caused by the flexion during installation.

When the adapter is to be removed, it is rotated into the position where it is approximately 90° to the face of the butt, allowing the adapter to be withdrawn from the buttstock.

The front face of the device, preferably manufactured without a chamfer, rests against a lip within the hollow stock. The adapter is braced against this lip when a recoil pad or other accessory is attached to the adapter via the two or more screw holes. The screw holes are configured to receive fasteners to attach a recoil pad or other accessory to the rear of the shotgun.

Recoil pads for use with the adapter are intended to absorb and dissipate the energy generated by the firearm during discharge, thereby reducing the amount of recoil felt by the shooter. This is particularly important for shotguns, which are known for their significant recoil due to the large bore diameter and heavy shot loads. Recoil pads are typically made from resilient, compressible, shock-absorbing materials such as rubber, polyurethane, or gel, and are attached to the butt end of the shotgun stock.

In a secondary embodiment, additional holes are present through the adapter to allow the active mechanism of an active recoil system, such as a Gracoil device, to be affixed to and interact with the adapter.

The shotgun hollow buttstock adapter offers several advantages over prior art solutions. For example, by providing a dedicated adapter to mechanically fasten recoil pads to hollow shotgun buttstocks, the invention eliminates the need for permanent modifications to the buttstock, such as drilling or tapping. This preserves the structural integrity of the buttstock and allows for easy installation and removal of recoil pads as needed. Moreover, the mechanical fastening ensures a secure and reliable connection between the recoil pad and the buttstock, minimizing the risk of loosening or detachment during use. These functions are accomplished without permanent modification, or the use of adhesives.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
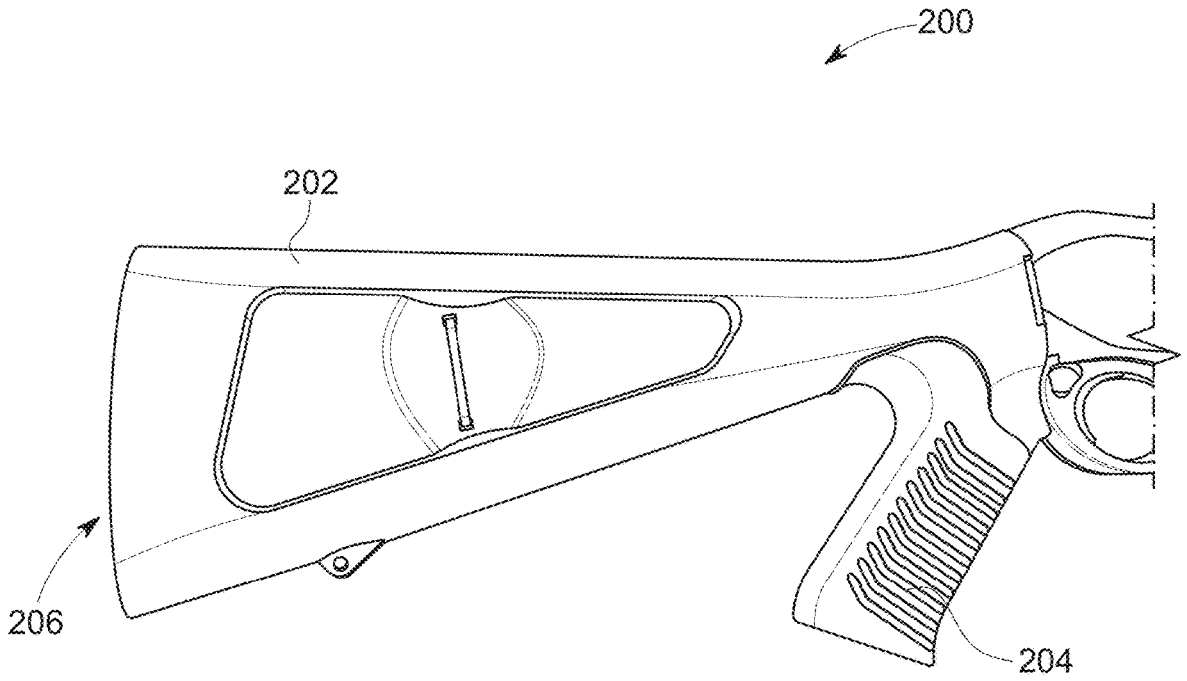
FIG. 1 illustrates a view of a shotgun buttstock.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of a shotgun buttstock is shown.

The shotgun 200 is shown with grip 204 and stock 202 with butt 206.

Figure 2:
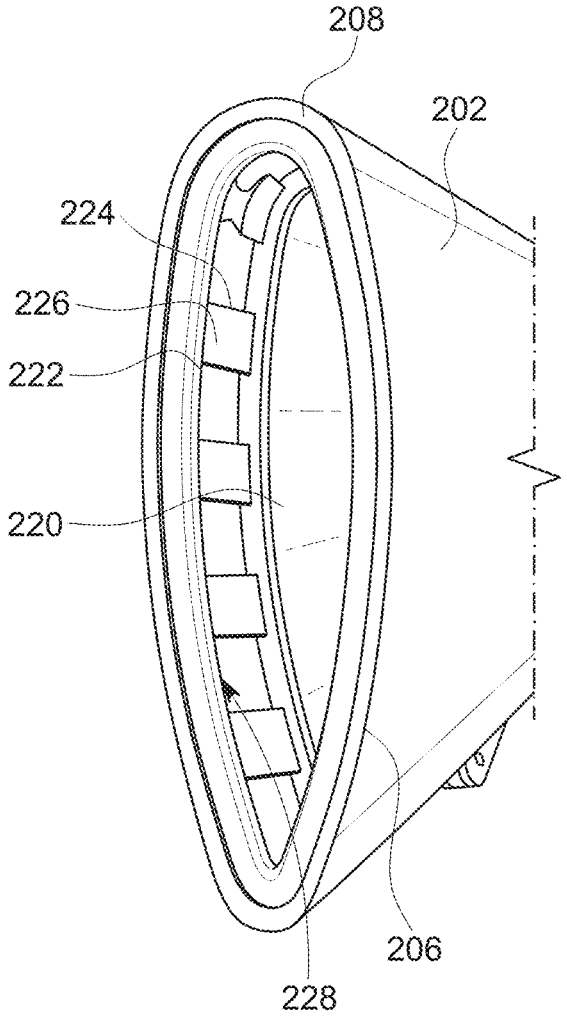
FIG. 2 illustrates a second view of a shotgun buttstock.

Referring to FIG. 2, a second view of a shotgun buttstock is shown.

The shotgun 200 is again shown with stock 202, with butt 206 having butt face 208. Within the hollow stock 202 is a cavity 220.

Within the end of the cavity, near the butt face 208, is a lip 222 adjacent to ribs 224, each rib 224 with a rib face 226.

Figure 7:
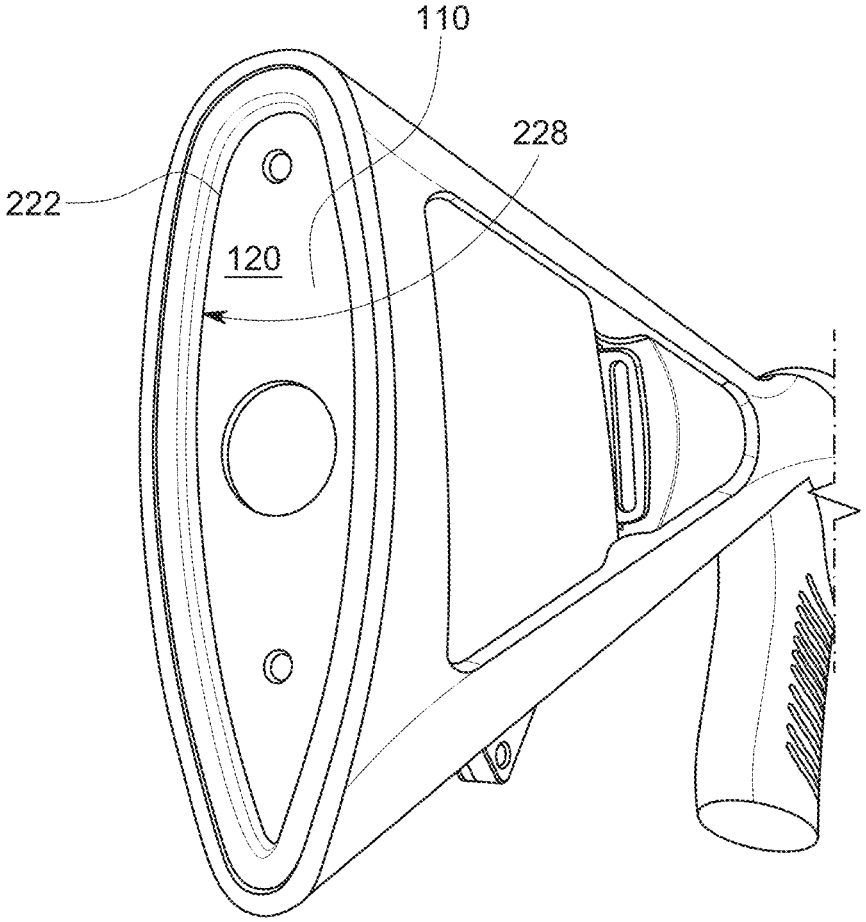
FIG. 7 illustrates a third view of the shotgun hollow buttstock adapter during installation.

Inside of the lip 222 is a support face 228 against which the adapter plate 110 will rest when installed (see FIG. 7).

Figure 3:
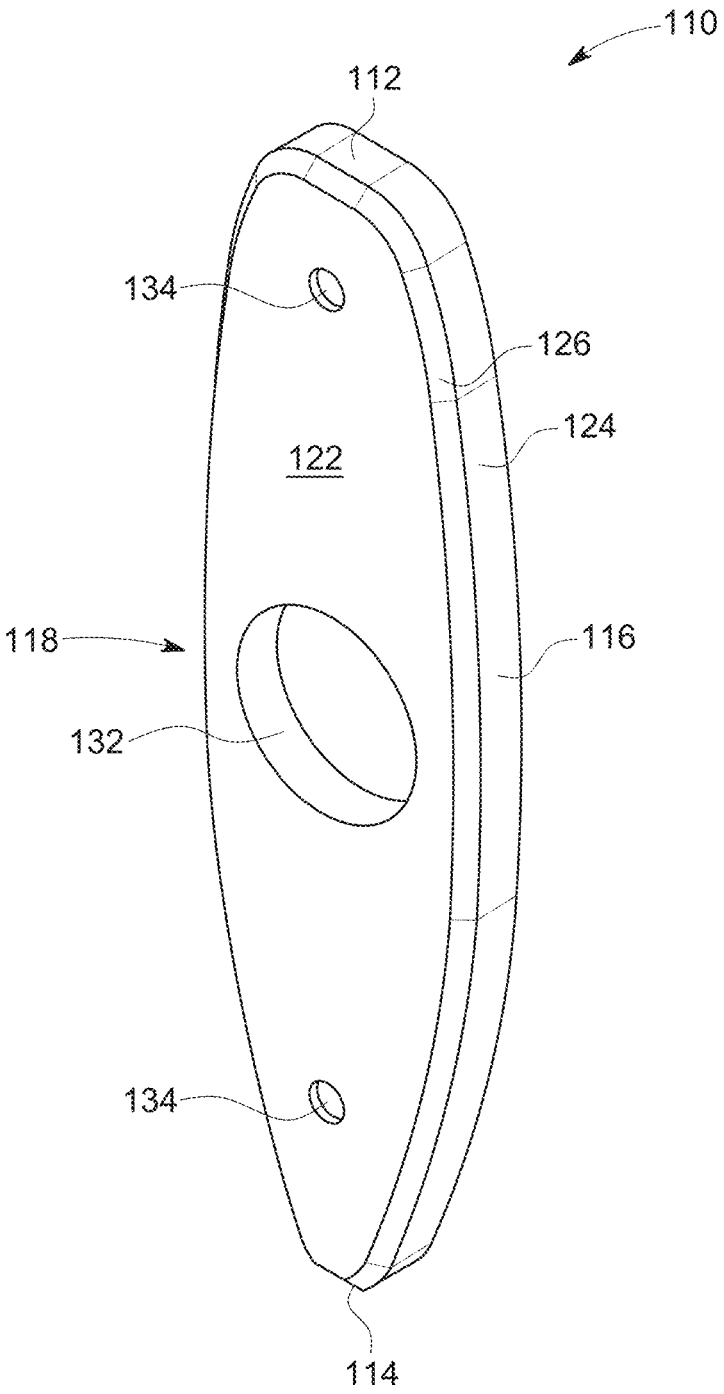
FIG. 3 illustrates a rear isometric view of the shotgun hollow buttstock adapter.
Figure 4:
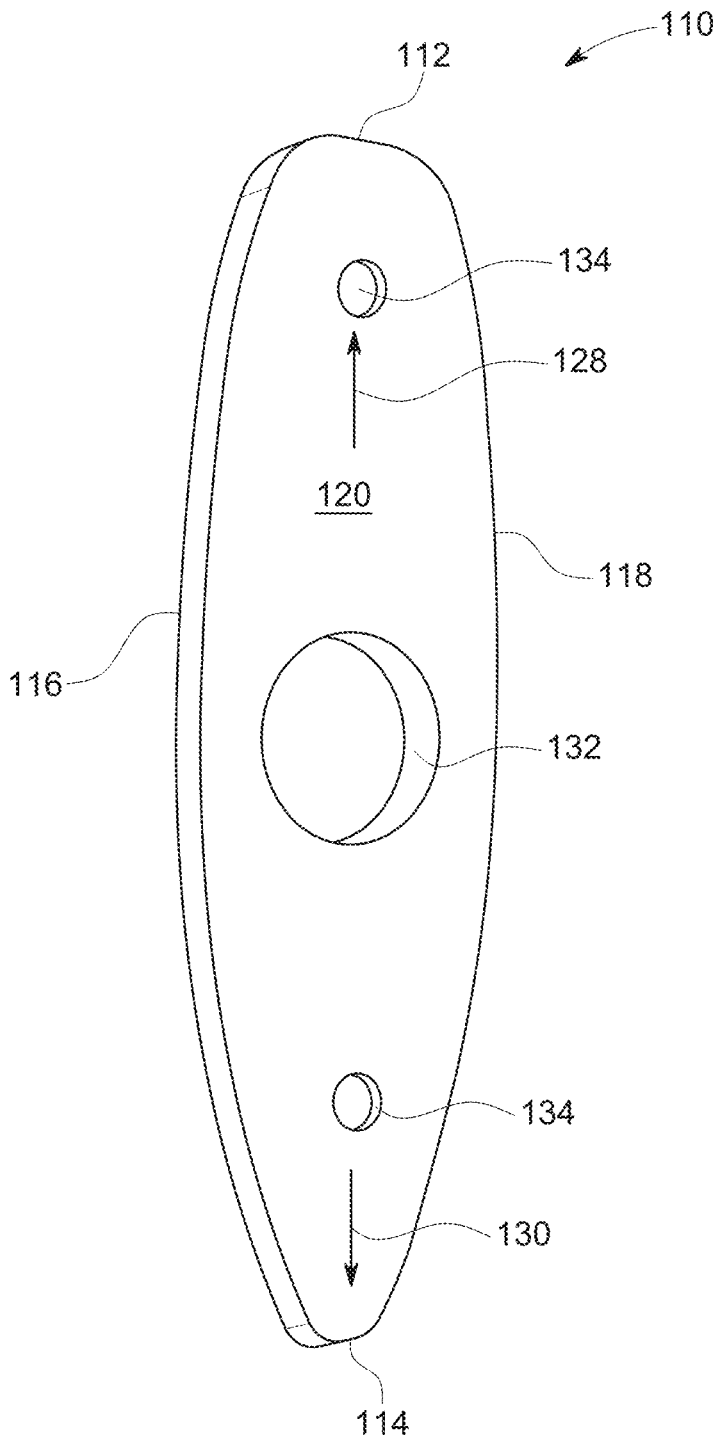
FIG. 4 illustrates a front isometric view of the shotgun hollow buttstock adapter.

Referring to FIGS. 3 and 4, a rear isometric view and a front isometric view of the shotgun hollow buttstock adapter are shown.

The adapter plate 110 includes a top 112 and bottom 114, left 116 and right 118 and edge 124.

Figure 6:
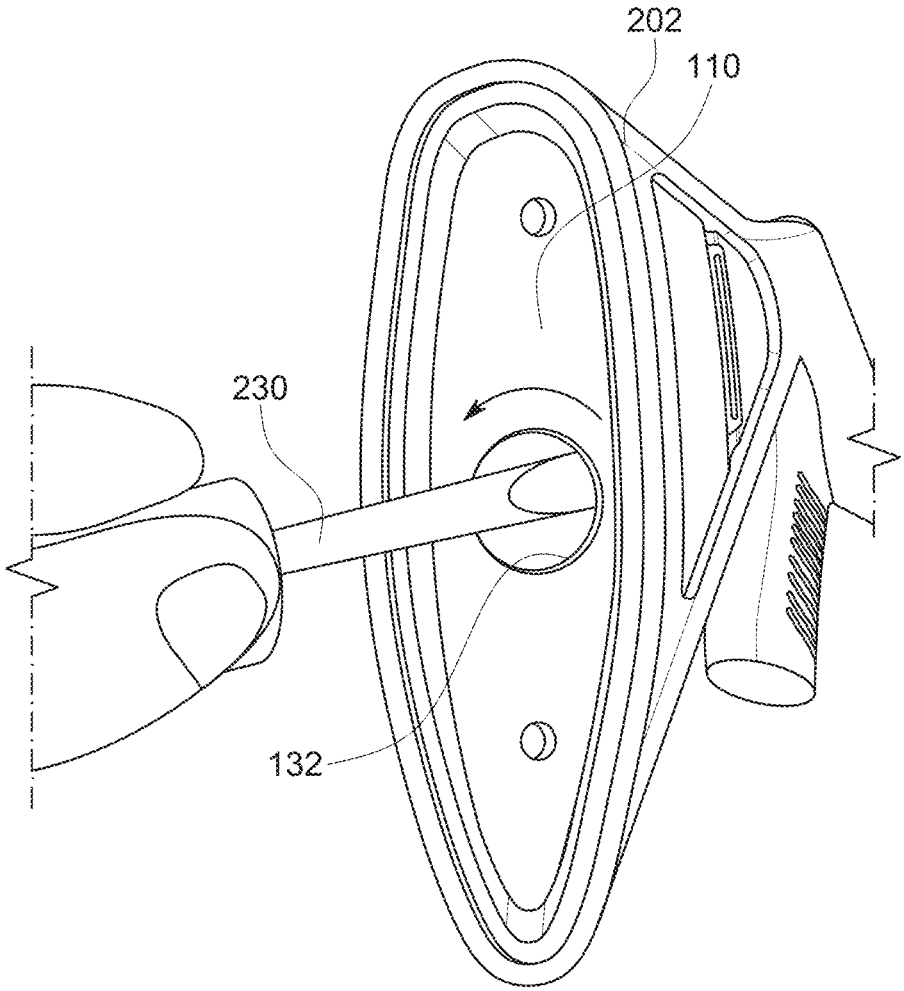
FIG. 6 illustrates a second view of the shotgun hollow buttstock adapter during installation.

The front face 120 faces toward the user after installation (see FIG. 6). The back face 122 faces inward and includes a chamfer 126 that helps the adapter plate 110 to rotate into position while minimizing distortion to the stock 202.

The adapter plate 110 includes a tapered shape to match the profile of the support faces 228 of the ribs 224 within the cavity 220 of the stock 202 (see FIG. 2). The upper taper 128 is the tapered shape from the center to the top 112, and the lower taper 130 is the tapered shape from the center to the bottom 114.

Also shown is the central hole 132 and mounting holes 134, which are optionally threaded.

The preferred dimensions of the adapter plate are 4.475 inches tall, 1.292 inches wide, and 0.25 inches thick.

The central hole 132 is preferably 0.805 inches in diameter. The mounting holes 134 are preferably drilled and threaded for #8-32 UNC screws.

Figure 5:
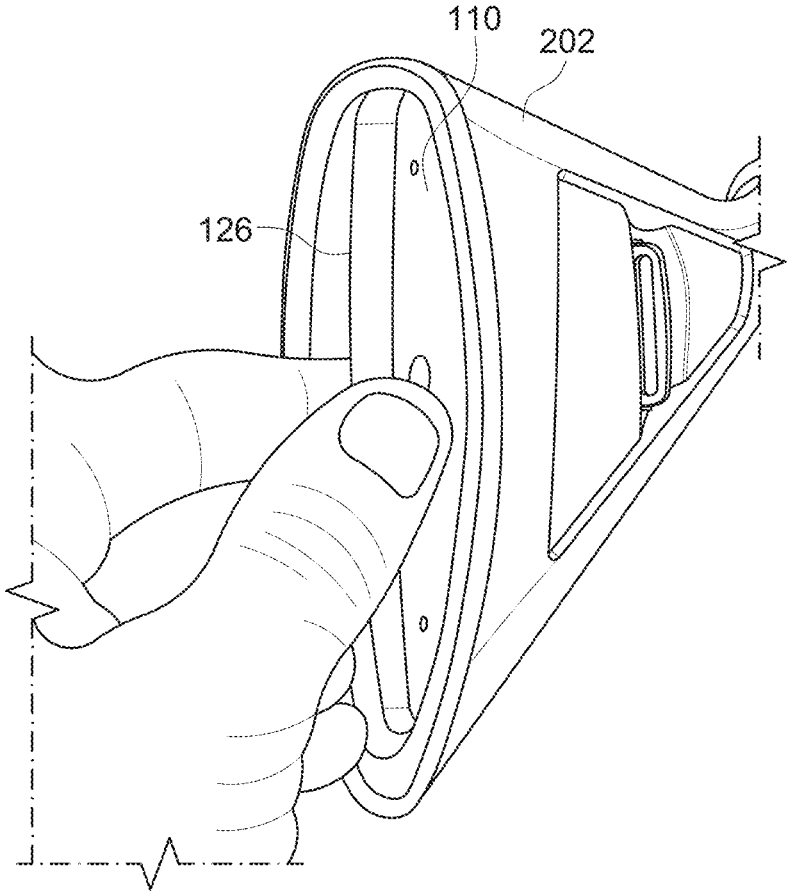
FIG. 5 illustrates a first view of the shotgun hollow buttstock adapter during installation.

Referring to FIG. 5, a first view of the shotgun hollow buttstock adapter during installation is shown.

The adapter plate 110 is started at approximately a 90° angle into the stock 202, the chamfer 126 intended for rotation toward the inside of the stock 202.

Referring to FIG. 6, a second view of the shotgun hollow buttstock adapter during installation is shown.

The adapter plate 110 is rotated, causing outward deformation of the walls of the stock 202. A tool 230, such as a screwdriver, is optionally used to generate the required torque to rotate the adapter plate 110 into place. The tool 230 is shown placed through the central hole 132.

Referring to FIG. 7, a third view of the shotgun hollow buttstock adapter during installation is shown.

The adapter plate 110 is shown in its final installed position, with the front face 120 visible. The outer perimeter of the front face 120 rests against the support face 228 of the lip 222.

Figure 8:
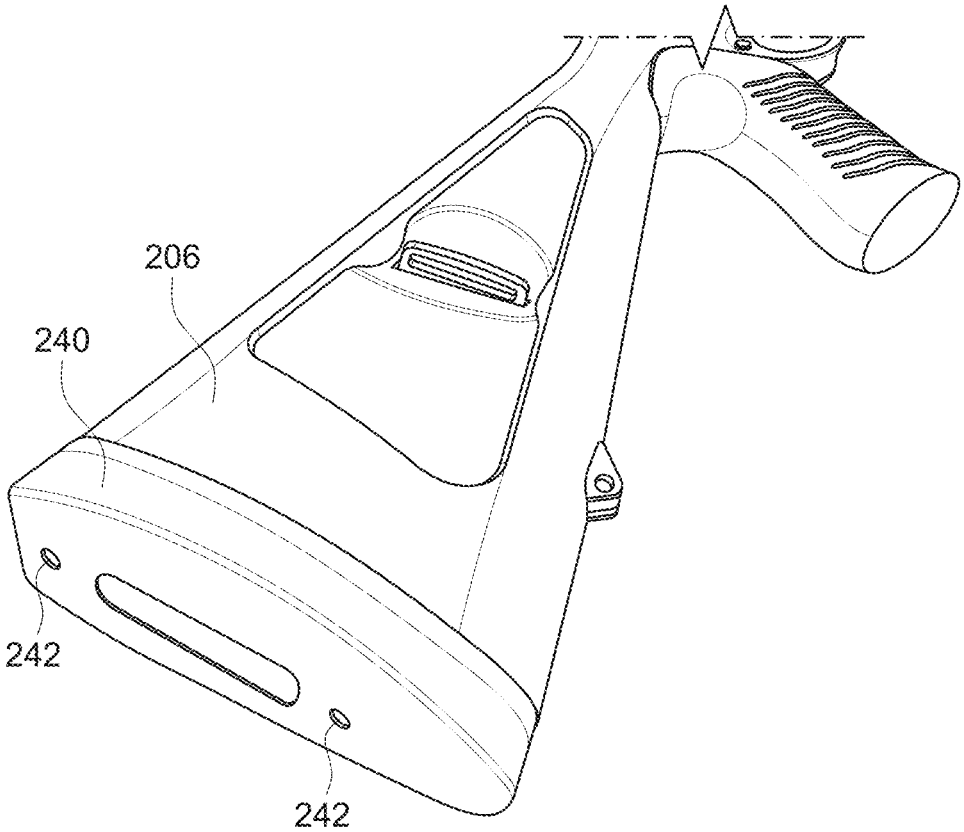
FIG. 8 illustrates a first view after installation of the recoil pad to the shotgun hollow buttstock adapter.
Figure 9:
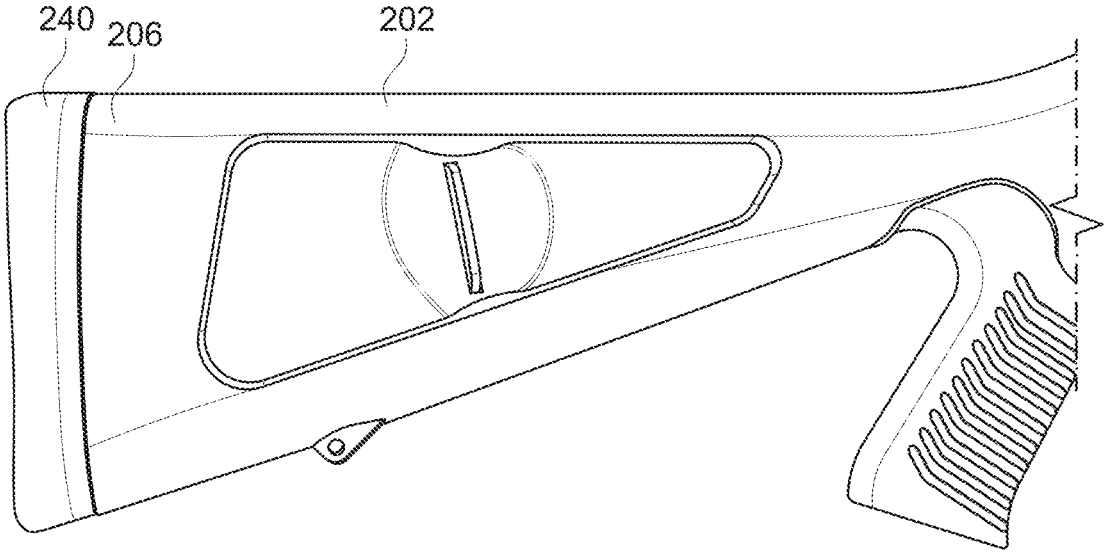
FIG. 9 illustrates a second view after installation of the recoil pad to the shotgun hollow buttstock adapter of the shotgun hollow buttstock adapter.

Referring to FIGS. 8 and 9, a first view and a second view after installation of the recoil pad to the shotgun hollow buttstock adapter are shown.

A pad 240 is shown installed against the butt 206 of the stock 202. Screws 242 pass through the pad 240, interfacing with the mounting holes 134 of the adapter plate 110 (see FIG. 4).

Figure 10:
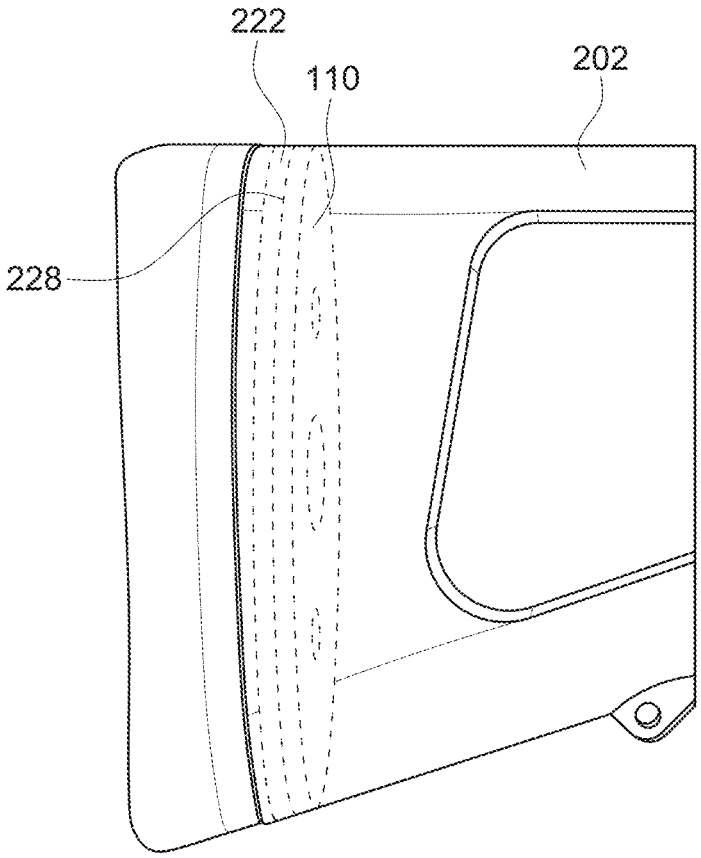
FIG. 10 illustrates a third view after installation of the recoil pad to the shotgun hollow buttstock adapter of the shotgun hollow buttstock adapter.

Referring to FIG. 10, a third view after installation of the recoil pad to the shotgun hollow buttstock adapter of the shotgun hollow buttstock adapter is shown.

The adapter plate 110, within the stock 202, rests against the support face 228 of the lip 222 (see FIG. 2).

Figure 11:
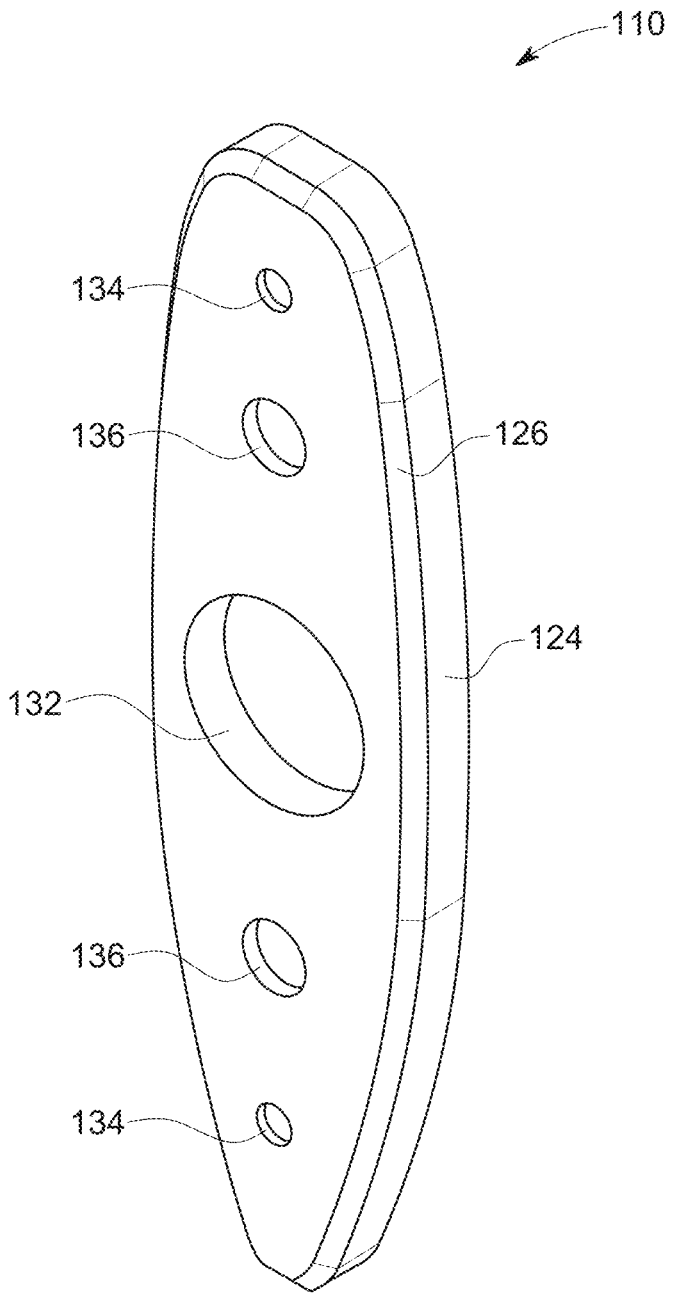
FIG. 11 illustrates a second embodiment of the shotgun hollow buttstock adapter.

Referring to FIG. 11, a second embodiment of the shotgun hollow buttstock adapter is shown.

In this embodiment, the adapter plate 110 includes the edge 124 with chamfer 126, and mounting holes 134 with central hole 132. Secondary holes 136 are added to support alternative recoil mechanisms that require additional mounting holes or the ability to pass through the adapter plate 110.

Figure 12:
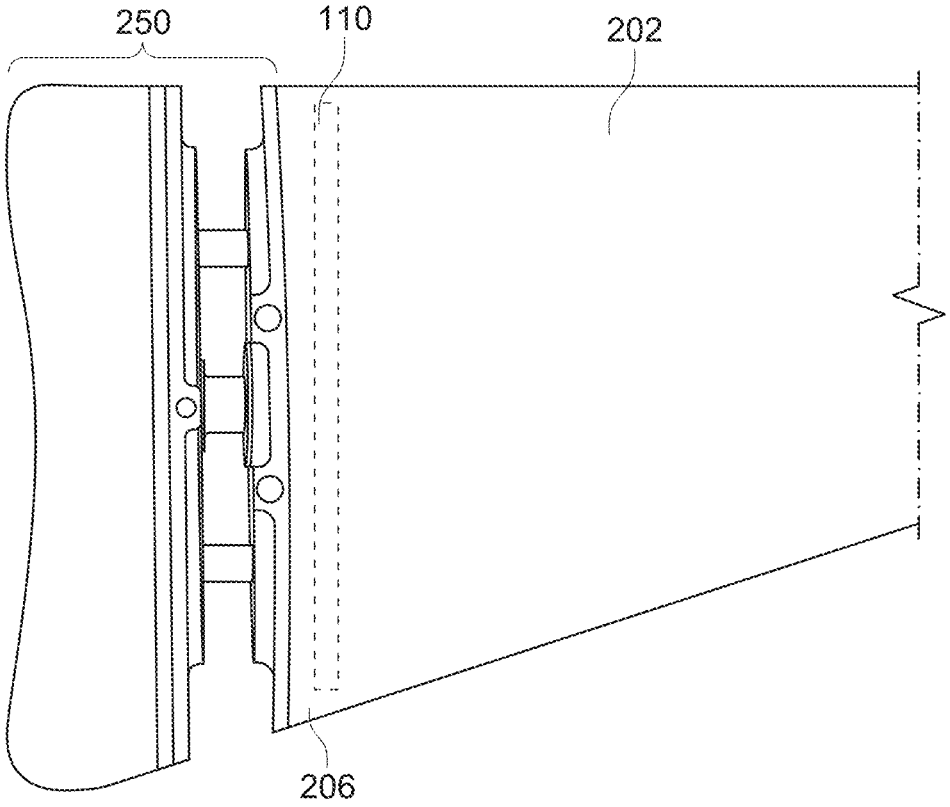
FIG. 12 illustrates a second embodiment of the shotgun hollow buttstock adapter with active recoil adapter after installation of the shotgun hollow buttstock adapter.

Referring to FIG. 12, a second embodiment of the shotgun hollow buttstock adapter with active recoil adapter after installation of the shotgun hollow buttstock adapter is shown.

The adapter plate 110 is used to mount a recoil absorption device 250 to the stock 202.

Figure 13A:
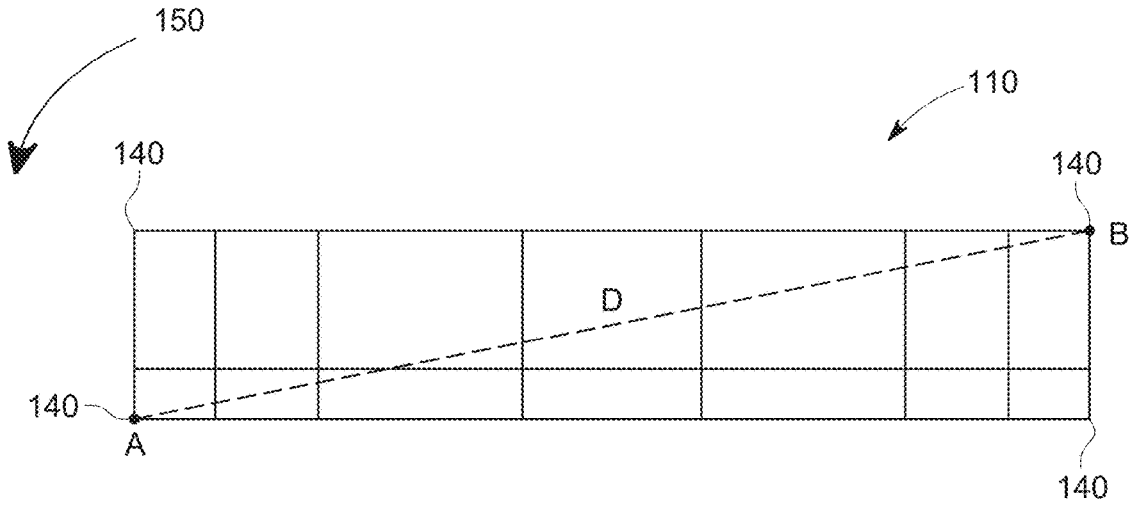
FIG. 13A illustrates the shotgun hollow buttstock adapter without a chamfered edge.
Figure 13B:
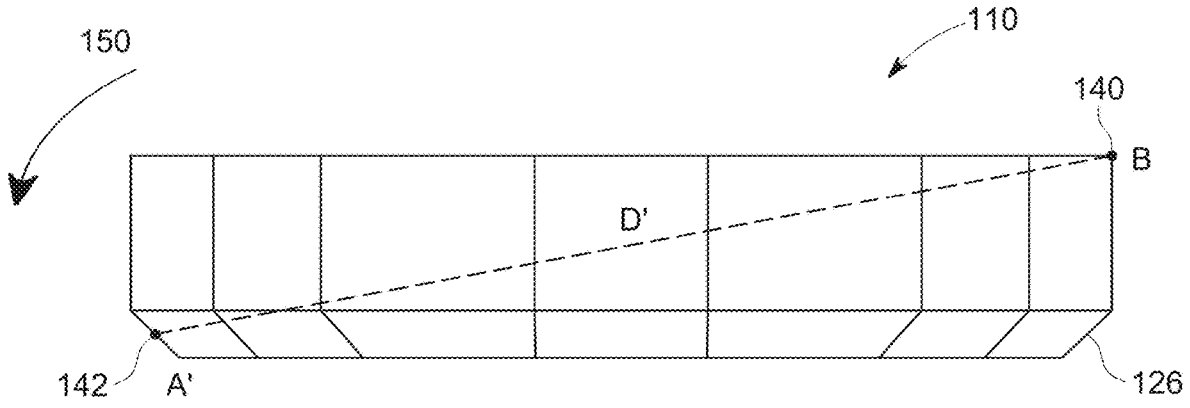
FIG. 13B illustrates the shotgun hollow buttstock adapter with a chamfered edge.

Referring to FIGS. 13A and 13B, a shotgun hollow buttstock is shown with and without the chamfered edge to show the change in length.

In FIG. 13A, the adapter plate 110 is shown with 90° corners 140, or corners without chamfers.

In FIG. 13B, the adapter plate 110 is shown with chamfer 126.

By virtue of the chamfer 126, distance D' from corner A to chamfered corner B is less than distance D from corner A to corner B.

The result is during installation of the adapter plate 110 within the stock 202, while the adapter plate 110 is being rotated in installation rotation direction 150, the deformation of the stock 202 (see FIG. 6) that is required to allow the adapter plate 110 to reach its final position is reduced. In other words, the chamfer 126 reduces the amount that the stock 202 must outwardly deform to allow the adapter plate 110 to rotate into position.

Equivalent elements can be substituted for the ones set forth above such that they perform in substantially the same manner in substantially the same way for achieving substantially the same result.

What is claimed is:

1. An adapter system, the adapter system comprising:

a firearm having a hollow stock, an end of the hollow stock having a lip and a stock height and stock width, the stock height and the stock width measured within the end of the hollow stock next to the lip;

a plate, the plate having an outer edge, front face, and a back face, the front face having a plate height that is substantially equal to the stock height and a plate width that is substantially equal to the stock width;

a chamfer along an entire junction between the back face and the outer edge, creating a chamfered edge;

the plate held within the firearm hollow stock by the lip of the firearm hollow stock engaged with the outer edge of the plate;

two mounting holes through the plate, each mounting hole of the two mounting holes is threaded to affix a recoil absorption device to the hollow stock;

a central circular hole for accepting a feature of the recoil absorption device; and wherein the chamfered edge is configured for insertion of the plate into the hollow stock and then to be rotated into place within the hollow stock with less deformation of the firearm hollow stock than if the plate lacked the chamfer.

2. The adapter system of claim 1, wherein:

the plate has a tapered shape, with a top and bottom that are narrower than a center;

the top wider than the bottom; and the tapered shape is contoured to match an internal profile of the hollow stock.

3. The adapter system of claim 1, further comprising:

at least one secondary hole for maintaining a position of the recoil absorption device with respect to the hollow stock.

4. The adapter system of claim 3, wherein the at least one secondary hole is two secondary holes.

5. An adapter system for attaching a recoil absorption device to a hollow stock of a firearm, comprising:

a firearm having a hollow stock;

an adapter body configured to be inserted into a hollow portion of the hollow stock of the firearm, the adapter body having a front face, a back face, and an outer edge delineated as being between the front face and the back face and traversing the entire adapter body;

the adapter body having a tapered profile that matches an internal wall shape of the hollow portion of the hollow stock;

the adapter body having an upper and a lower threaded hole for attaching a recoil absorption device to the adapter body using screws;

the adapter body having a central circular bore for accepting a feature of the recoil absorption device;

a chamfered edged disposed along an entire perimeter of the back face of the adapter body; and wherein the outer edge of the adapter body is configured to be wedged behind a lip of the hollow stock after installation into the hollow portion of the hollow stock and is therefore held within the hollow portion of the hollow stock by the lip;

wherein the outer edge of the adapter is configured to rest behind the lip at a butt end of the hollow stock when the adapter body is in a final position of the installation, thereby securing the adapter within the hollow portion of the hollow stock.

6. The adapter system of claim 5, further comprising:

a chamfered edge disposed along an entire perimeter of the back face of the adapter body.

7. The adapter system of claim 5, wherein:

the adapter body is configured to be inserted into the hollow stock at a 90° angle relative to the final position and then rotated into the final position.

8. The adapter system of claim 5, wherein:

the adapter body is held in the final position by the lip of the hollow stock against the outer edge of the adapter body.

9. The adapter system of claim 5, further comprising:

a front face configured to rest against the lip within the hollow stock when the adapter body is in the final position.

10. The adapter system of claim 9, further comprising at least one additional hole for accepting a feature of the recoil absorption device that maintains alignment of the recoil absorption device with respect to the hollow stock.

11. The adapter system of claim 5, wherein:

the adapter body is configured to be removed from the hollow stock by rotating the adapter to a position approximately 90° relative to a face of the hollow stock and withdrawing the adapter body.

* * * * *